US005787739A

United States Patent [19]

Derman

[11] Patent Number: 5,787,739

[45] Date of Patent: Aug. 4, 1998

[54] SECURITY HOLE FASTENING DEVICE

[75] Inventor: Jay S. Derman, Redondo Beach, Calif.

[73] Assignee: ACCO Brands, Inc., Lincolnshire, Ill.

[21] Appl. No.: 825,213

[22] Filed: Mar. 27, 1997

Related U.S. Application Data

[63] Continuation-in-part of Ser. No. 680,184, Jul. 15, 1996, abandoned.

[51] Int. Cl.[6] ..... E05B 69/00

[52] U.S. Cl. ..... 70/58; 70/14; 70/158

[58] Field of Search ..... 70/14, 18, 58, 70/423, 424, 426, 428, 430, 63, 158

[56] References Cited

U.S. PATENT DOCUMENTS

| | | | |
|---|---|---|---|
| 505,299 | 9/1893 | Schneider | 70/428 |
| 934,928 | 9/1909 | Michel | 70/428 |
| 5,390,977 | 2/1995 | Miller | 297/216.13 |

FOREIGN PATENT DOCUMENTS

| | | | |
|---|---|---|---|
| 454901 | 3/1949 | Canada | 70/424 |
| 455740 | 3/1913 | France | 70/424 |
| 1085107 | 1/1955 | France | 70/424 |
| 456219 | 2/1928 | Germany | 70/424 |
| 14095 | 5/1905 | Norway | 70/424 |
| 447091 | 5/1936 | United Kingdom | 70/424 |

*Primary Examiner*—Flemming Saether
*Assistant Examiner*—Tuye T-Phuong
*Attorney, Agent, or Firm*—Townsend and Townsend and Crew LLP

[57] ABSTRACT

A device for fastening equipment subject to theft and provided with a security hole, by inserting the device in the security hole located on the outside surface of the equipment. The device consists of two identically shaped metal plates having a hooked tang protruding from one edge, and a clip member that will hold the two plates together closely. The plate tangs are inserted through the security hole so that the hooks grip the hole edges and the plates are wedged in back to back and against the equipment outer shell by the clip member. This holds the plates and hooks in place, making it impossible for either of the plates to come loose or be pulled out of the hole at the same time. A through hole is provided for attaching a cable or padlock to the fastening device, thus securing the equipment from theft.

4 Claims, 2 Drawing Sheets

SECURITY HOLE FASTENING DEVICE

This application is a Continuation-In-Part of prior application Ser. No. 08/680,184, which is now abandoned.

BACKGROUND OF THE INVENTION

1. Field of the Invention

The invention relates to a device for fastening equipments to locking cables and preventing theft of the equipments.

2. Prior Art

There presently exists a number of devices and methods for securing equipment from theft. Typically, these methods include a fastening block which is either adhered to or screwed to the back of an equipment. A wire cable or metal chain is then attached to the fastening block and the ends of the cable or chain are looped around a suitable immovable object and locked in place. This prevents the equipment from being removed by unauthorized persons. U.S. Pat. No. 5,351,507 "Wire Cable Locking Device" by Jay S. Derman describes one such approach which is found to be successful.

In order to standardize the available methods of fastening securing devices to equipment, industry has recently begun the practice of incorporating 'security holes' in the outer shell of certain equipments. These holes are in the form of a rectangular shaped slot or a circular hole shape. A circular hole would permit rotating a fastener in the hole 360 degrees, which could be advantageous for some equipments and be easier to construct.

It is intended that the securing method utilize a fastener that can be inserted in the provided equipment security hole and thereby secure the equipment to a cable or padlock.

For the convenience of the user, and the equipment manufacturer, the fastener should be able to stay attached to the equipment once it is inserted in the security hole, and not require an externally applied means such as a lock or cable to hold it there. Loose fasteners have been found to easily fall out of equipment security holes during attachment of a group of equipments to a cable, causing unnecessary bother. The same thing may occur when one or more equipments are removed from a securing cable for any reason, such as during a sale. It is therefore, highly desirable to have a security hole fastener that will stay in place once inserted, and will take particular effort to be removed.

There are presently known to be a number of fastener devices that might, with some modification, be used to fasten to an equipment security hole. These include the devices according to F. Michel, U.S. Pat. No. 934,928; to O.J. Lofquist, U.S. Pat. No. 2,383,397; to I. Nielsen, Norwegian Pat. No. 14095; and to M. Boucher, French Pat. No. 1,085,107. In each of these patents, the devices are described as having arms pivoting together to be swung crosswise after insertion in a given hole. The external ends of the device arms must be held together by means such as a padlock or cable, else the fastener device will loosen in the security hole and possibly fall out.

There are also a number of more modern fasteners available on the market, usually employing a two arm, swivel approach to grip the equipment. However, as is the case for the older fasteners such as Michel '928, these fasteners will loosen and possibly fall out of the equipment security hole without an external lock or cable to hold the arms pressed against the equipment walls.

SUMMARY OF THE INVENTION

The present invention is a fastening device for insertion in a security hole in any equipment, comprising two identical aperture insert plates, each having a projecting, hooked tang, and which are designed to hook, back to back, into an equipment security hole, and a U shaped clip member that fits over both aperture insert plates, holding the plates together.

A hole in the aperture insert plates and the clip member provides means for attaching the fastening device to a securing cable. Only the tang portion of an aperture insert plate can enter the security hole. The tang hooks bear on the inside surface of the equipment shell while the plates shoulder edges bear on the outside surface of the equipment, as do the edges of the clip member. Thus the fastening device is held at all times against the equipment surface and can not loosen or be pulled out without careful disassembly.

Accordingly, a prime object of the invention is to provide a simple fastener device that will not come loose after insertion in an equipment security hole.

Another object of the invention is to provide an inexpensive fastener device capable of being used universally in security holes of any equipment.

DESCRIPTION OF THE PREFERRED EMBODIMENT

Figure 1:
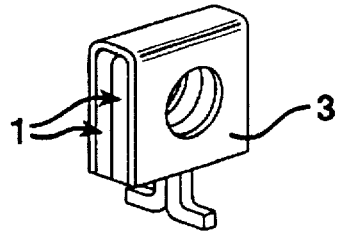
FIG. 1 is a perspective view of an assembled fastening device according to the present invention.

Referring particularly to the drawings, there is shown in FIG. 1 a perspective view of a preferred embodiment of an assembled device according to the present invention. The device consists of two identical aperture insert plates 1 and a U shaped clip member 3. Protruding out beneath the clip member 3 are the hooked tangs of the insert plates 1.

Figure 2:
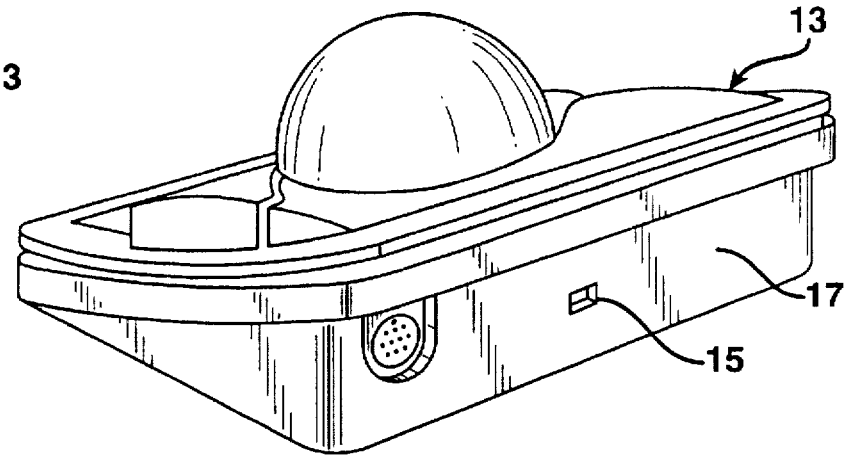
FIG. 2 is perspective view of an example equipment, particularly showing a security hole in its rear shell surface.

Refer now to FIG. 2 which illustrates a typical computer equipment accessory 13, having a security hole 15 in its shell surface 17.

When the tang of each insert plate 1 is properly inserted into a security hole 15, the hooked portion of each tang will bear against the inside surface of the equipment shell 17 around the hole 15. Placing the clip member 3 over the insert plates 1 makes the plates assume a back-to-back configuration, with the tang hook portions pointed outwards as shown in FIG. 1. This produces an even grip on the inside surface of the equipment shell 17.

As shown in FIG. 1, the clip member 3 is sized to fit closely over the insert plates 1 so that they are held together, although not gripped tightly. A hole passes through the approximate center of the device and is provided for accommodating a securing cable or padlock. The use of a cable is illustrated in FIG. 3 which is a partial view of a computer accessory equipment 13, showing a portion of a cable 21 passed through the fastening device clip 3 and insert plates 1.

Figure 3:
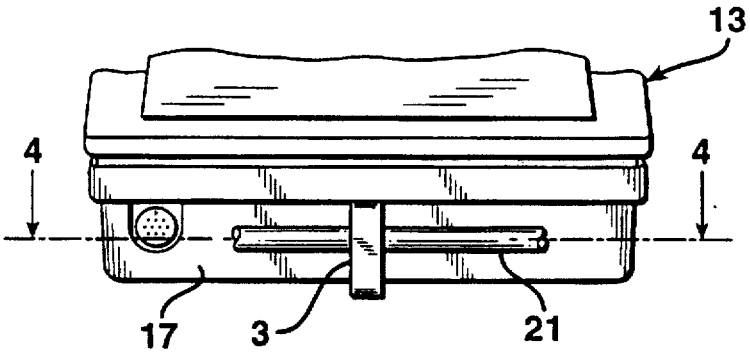
FIG. 3 is a partial rear view of an equipment, showing the invention fastening device installed in a security hole and a cable attached passing through the fastening device.
Figure 4:
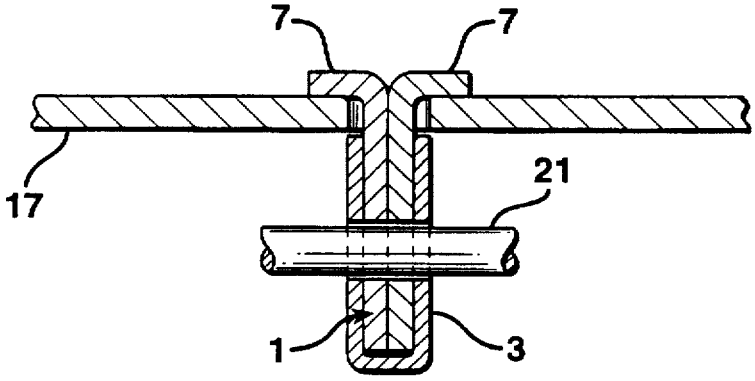
FIG. 4 is a sectional, partial top view of the rear shell of an equipment taken along line 4—4 of FIG. 3, particularly showing the invention parts as installed in a security hole with a cable attachment.

Refer now to FIG. 4 which is a partial cross-section view of an equipment back shell 17 and the fastening device inserted in a security hole taken along line 4—4 of FIG. 3. As can be seen, the tangs 7 of the insert plates 1 are inserted through the security hole in the back shell 17, with the hooked parts of the tangs 7 facing in opposite directions.

The underside of the bent part of the tang 7 now bears against the inside surface of the equipment back shell 17, and is held in that position by the clip member 3 which is pushed up against the outside surface of the shell 17. Thus, the device insert plates 1 are held tightly in a security hole and are prevented from accidentally coming loose. Placing a cable 21 or a padlock arm through a hole in the fastening device makes it virtually impossible to remove or loosen.

For loosening, the insert plates 1 can be carefully removed from the security hole after first removing the clip member 3.

Figure 5:
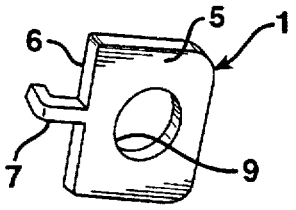
FIG. 5 is a generally perspective view of one of two identical aperture insert plates.
Figure 6:
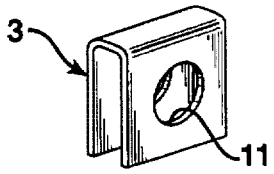
FIG. 6 is a perspective view of a clip member which fits over the aperture insert plates.

Refer now to FIGS. 5 and 6 which show detail of an aperture insert plate 1 and a clip member 3.

Each aperture insert plate 1 is made of rigid metal and is formed into two portions. The first portion 5 is in a first plane being a flat tab, and having two paralleled straight side surfaces, a straight or curved surface at one end, and a parallel straight edge at its distal end 6. This distal end 6 has a shoulder formed in it and an attachment of a second portion which is a tang 7, to its center.

Part of the tang 7 length is in the first plane with the first portion, and the remaining tang 7 length is bent in a second plane at 90 degrees to the first plane, forming a hook. A first hole 9 is cut in the approximate center of the first portion 5 of the insert plate and sized to accommodate a security cable or padlock arm with clearance.

The thickness of each aperture insert plate 1 is approximately half or slightly less, than the largest dimension of a security hole, to ensure that two of the insert plate tangs 7 can fit at the same time into a standard security hole with clearance.

As shown in FIG. 6, the clip member 3 is made of a flat metal sheet, folded to form a "U" with both paralleled arms of the U equal in length. The width of the space between each arm is made equal to twice the thickness of each insert plate 1 plus clearance to permit placing the clip member 3 over the edges of both insert plates at the same time. The face width and length of the clip member arms are made slightly larger than the face width and length of the first portion 5 of an aperture insert plate 3. This ensures that the ends of the clip member 3 arms can extend slightly beyond the shoulder 6 edges of the insert plates 3 when the device is assembled in a security hole.

A second hole 11 is cut in the approximate center of the face of each paralleled arm of the clip member 3. The second hole is sized and located to match with the first hole in each of the insert plates 1, allowing a cable or a padlock arm to be inserted.

Figure 7:
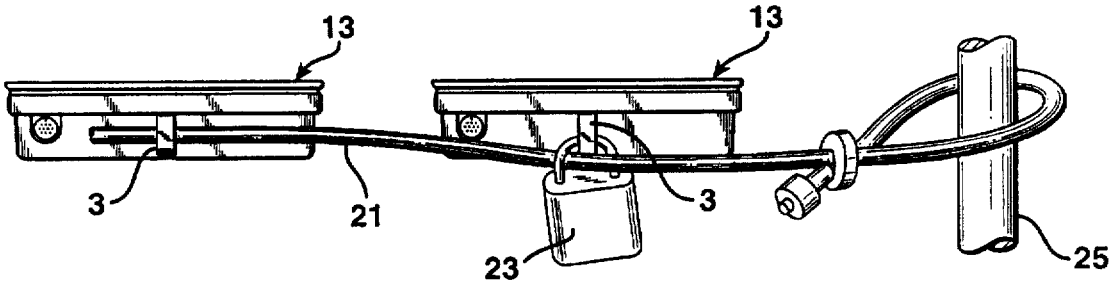
FIG. 7 is a view illustrating how two or more equipments having security holes may be fastened by the present invention device to a cable or padlock for securing from theft.

Finally, FIG. 7 illustrates one accepted method where the invention devices may be used together with security holes in equipments to secure the equipment against theft. In the illustration, a computer equipment 13 is being secured to a cable 21 by having the cable 21 pass directly through the cable hole in the clip member 3 when the aperture insert plates have their tangs inserted in its security hole. This approach might be used where the several different equipments of a system are being secured together on one cable as would be the case in an office. The other equipment 13 has a padlock 23 arm going through the holes in its attached fastening device and the cable 21 passing through the padlock 23. This approach would most likely be used in a store where several equipments are being displayed and it is desired to be able to unlock and remove any one of the equipments separately.

As an example of how the equipment may be secured by a cable 21, the cable is shown having one end passed through a collar, looped around an immovable pole 25 with its end passing back through the collar and a clamp is locked on the end. The other end of the cable (not shown) would have a similar locked clamp attached to prevent pull through.

The invention fastener device is offered particularly to computer equipment owners and owners of other small size equipment as a simple, economic device that will be easy to attach to equipment and will facilitate securing the equipment from theft. The fastener device, once installed, will not accidentally loosen or fall out of the security hole at any time, whether or not it is secured by a cable or other lock.

The fastener device may be installed in any equipment that has a round or slotted security hole, and it is intended to be a universal fastener. The objects of this invention are then seen to be achieved.

Alternative embodiments and modifications may be apparent to those skilled in the art. These alternatives and modifications are considered to be within the spirit and scope of the present invention.

Having described the invention, what is claimed is:

1. A device for fastening to equipment subject to theft and provided with a security hole in an equipment outer shell, said device comprising:

two aperture insert plates; each said aperture insert plate being formed in a first portion and a second portion, said first portion being a metal tab located in a first plane and said second portion being an outwardly projecting tang which is connected to one end of said tab, said tang being bent at approximately 90 degrees forming a hook end and having its connected end in said first plane, and a distal free end in a second plane at approximately 90 degrees to said first plane, said tang outwardly projecting from a straight edge of said tab forming two shoulder edges on said tab, said tang and said tab being sized in width so that said tab is wider than said tang and only said tang is adapted to be inserted in said security hole; an underside of said distal free end of said tang being separated from said shoulder edges by a distance adapted to be substantially equal to the estimated thickness of said equipment outer shell plus clearances, in order to ensure that said tang hook end will bear tightly against the inside surface of said equipment outer shell;

a metal clip member, said clip member shaped and sized to fit closely over the two said aperture insert plates when both plates are placed back-to-back with their tang hooks projecting in opposite direction, said clip member having parallel sides, each with a surface of a size that is adapted to enclose an outer planar surface of each of said aperture insert plates; and means for attaching a security cable or padlock to said device;

said device being attached to said security hole by insertion of the tangs of two said aperture insert plates one at a time, into said security hole in a manner where the hook portions of said tangs fasten over opposite inside faces around said security hole, said insert plates each being held closely against the other and against said equipment outer shell by said clip member, preventing either insert plate from coming loose or being pulled out together or one at a time.

2. The fastening device as defined in claim 1, wherein said means for attaching a security cable or padlock include:

a first hole cut in an approximate center of the width of said planar surface of said tab of each said aperture insert plate, said first hole being sized to accommodate the security cable or padlock with clearance; and a second hole cut in an approximate center of the widths of opposite side surfaces of said clip member, the location and size of said second hole being such that when assembled with two of said aperture insert plates, said second hole will match said first hole permitting attaching of a security cable or a padlock to said device.

3. The fastening device as defined in claim 2, wherein said clip member is U-shaped.

4. The fastening device as defined in claim 1, wherein said first portion of said aperture insert plate is flat-shaped.

* * * * *